US010982421B2

(12) United States Patent
Mori et al.

(10) Patent No.: US 10,982,421 B2
(45) Date of Patent: Apr. 20, 2021

(54) FLUSH TOILET

(71) Applicant: TOTO LTD., Kitakyushu (JP)

(72) Inventors: Masaki Mori, Kitakyushu (JP); Shu Kashirajima, Kitakyushu (JP); Takahiro Hara, Kitakyushu (JP)

(73) Assignee: TOTO LTD., Fukuoka (JP)

( * ) Notice: Subject to any disclaimer, the term of this patent is extended or adjusted under 35 U.S.C. 154(b) by 0 days.

(21) Appl. No.: 16/528,482

(22) Filed: Jul. 31, 2019

(65) Prior Publication Data

US 2020/0063418 A1 Feb. 27, 2020

(30) Foreign Application Priority Data

Aug. 27, 2018 (JP) ..... JP2018-158423

(51) Int. Cl.
*E03D 1/38* (2006.01)

(52) U.S. Cl.
CPC ..... *E03D 1/38* (2013.01)

(58) Field of Classification Search
CPC ..... E03D 1/38
USPC ..... 4/420, 300, 256.1, 901, 905
See application file for complete search history.

(56) References Cited

U.S. PATENT DOCUMENTS

| | | | |
|---|---|---|---|
| 2016/0222641 | A1 | 8/2016 | Urata et al. |
| 2017/0241120 | A1 | 8/2017 | Matsuo et al. |
| 2020/0378102 | A1* | 12/2020 | Momoe ..... E03D 11/08 |

FOREIGN PATENT DOCUMENTS

| | | | |
|---|---|---|---|
| CN | 105839752 | A | 8/2016 |
| CN | 107740472 | A | 2/2018 |
| JP | 2017-150295 | A | 8/2017 |
| JP | 6332606 | B2 | 5/2018 |

OTHER PUBLICATIONS

An Office Action; "Notification of Reasons for Refusal," mailed by the Japanese Patent Office dated Jul. 27, 2020, which corresponds to Japanese Patent Application No. 2018-158423 and is related to U.S. Appl. No. 16/528,482; with English language translation.

An Office Action mailed by China National Intellectual Property Administration dated Aug. 4, 2020, which corresponds to Chinese Patent Application No. 201910588507.6 and is related to U.S. Appl. No. 16/528,482 with English language translation.

* cited by examiner

*Primary Examiner* — Lori L Baker
(74) *Attorney, Agent, or Firm* — Studebaker & Brackett PC

(57) ABSTRACT

A flush toilet includes: a toilet main unit having a bowl portion, and a water conduit formed in the toilet main unit and configured to supply flush water into the bowl portion. The water conduit has: a first water-guiding portion extending from a water supply portion to a first spout port located on one of right and left sides of the bowl portion; and a second water-guiding portion extending from the water supply portion to a second spout port located on the other of the right and left sides of the bowl portion. The water supply portion is located at a right-sided or left-sided position in a right and left direction. The flush water is supplied to the water supply portion in a direction inclined with respect to a front and back direction and intersected with an inside surface of the water supply portion, as seen in plan view.

7 Claims, 6 Drawing Sheets

FLUSH TOILET

TECHNICAL FIELD

The present invention pertains to a flush toilet, and more particularly to a flush toilet for flushing a toilet main unit with flush water.

BACKGROUND ART

Conventionally, as set forth in JP-B-6332606, for example, a flush toilet has been known wherein the flush toilet comprises a bowl portion and a rim spout port configured to spout flush water along a rim portion and wherein the flush water spouted from the rim spout port along the rim portion performs a flush as it circulates (swirls) over the interior of the bowl portion.

More specifically, as described in JP-B-6332606, a water conduit for supplying the flush water to the rim spout port (and thus to the interior of the bowl portion) has a first water-guiding portion extending from a water supply portion (branch portion), where the flush water is supplied to the water conduit, toward one of right and left sides of the bowl portion, and a second water-guiding portion extending from the water supply portion (branch portion) toward the other of the right and left sides of the bowl portion. The water supply portion (branch portion) is located at a central position in the right and left direction with respect to the bowl portion.

Patent Document List

JP-B-6332606

SUMMARY OF INVENTION

Technical Problem

Recently, it has been studied to make a flush toilet more compact in order to improve the design quality thereof. For example, it has been studied to make a flush toilet more compact in the forth and back direction in order to achieve a flush toilet whose forward projection is smaller.

Conventionally, as described in JP-B-6332606, the water supply portion (branch portion) is located at a central position in the right and left direction with respect to the bowl portion. The inventors of the present invention have been studied to make a flush toilet more compact in the forth and back direction by shifting the water supply portion (branch portion) from the central position to a right-sided or left-sided position.

The present invention has been made under the above background. The object of the present invention is to provide a flush water whose size in a forth and back direction thereof can be made compact.

Solution to Problem

The present invention is a flush toilet including: a toilet main unit having a bowl portion; a water conduit formed in the toilet main unit and configured to supply flush water into the bowl portion; wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion; the water supply portion is located at a right-sided or left-sided position in a right and left direction with respect to the bowl portion; the flush water is supplied to the water supply portion in a direction inclined with respect to a front and back direction and intersected with an inside surface of the water supply portion, as seen in plan view.

According to the above feature, since the water supply portion is located at a right-sided or left-sided position in a right and left direction with respect to the bowl portion, the size of the flush toilet can be made compact in the forth and back direction.

In addition, in the present invention, if an angle at which the flush water is supplied to the water supply portion is adjusted, a ratio (distribution ratio) between an amount of the flush water supplied to the first water-guiding portion (i.e., an amount of the flush water to be spouted from the first spout port) and an amount of the flush water supplied to the second water-guiding portion (i.e., an amount of the flush water to be spouted from the second spout port) can be adjusted to a desired value.

It is preferable that the flush water is supplied to the water supply portion in a direction substantially perpendicular to a tangential direction of the inside surface of the water supply portion. In the present specification, the term "substantially perpendicular" means the range of about 75 degrees to 105 degrees.

As a concrete structure, in an preferable embodiment, the flush water may be supplied to the water supply portion by a straight nozzle extending in a direction inclined with respect to the front and back direction and intersected with the inside surface of the water supply portion, as seen in plan view; the straight nozzle may be connected to a water supply tube; and the water supply tube may have a proximal portion extending in the front and back direction, a distal portion connected to the straight nozzle and extending in the same direction as the straight nozzle, and a bend portion bending from the proximal portion to the distal portion.

According to the above embodiment, an operation for setting the nozzle is easy. In addition, a space in which the nozzle is to be set can be also made compact.

Alternatively, in another preferable embodiment, the flush water may be supplied to the water supply portion by a bend nozzle; the bend nozzle may have a proximal portion extending in the front and back direction, a distal portion extending in a direction inclined with respect to the front and back direction and intersected with the inside surface of the water supply portion as seen in plan view, and a bend portion bending from the proximal portion to the distal portion; and the bend nozzle may be connected to a water supply tube extending in the front and back direction.

According to the above embodiment as well, an operation for setting the nozzle is easy. In addition, a space in which the nozzle is to be set can be also made compact.

Alternatively, in another preferable embodiment, the flush water may be supplied to the water supply portion by a water supply passage extending in a direction inclined with respect to the front and back direction and intersected with the inside surface of the water supply portion, as seen in plan view; and the water supply passage is connected to a water supply tube via a buffer chamber which allows the flush water to temporarily stay.

According to the above embodiment, since the flush water is allowed to temporarily stay in the buffer chamber, effects caused by a direction in which the flush water is supplied from the water supply tube into the buffer chamber can be reduced, so that the flush water can be more precisely supplied to the water supply section along the direction of the water supply passage.

In this case, more preferably, the buffer chamber has a wall formed at a position against a direction in which the flush water is supplied from the water supply tube into the buffer chamber.

According to the above feature, the effects caused by the direction in which the flush water is supplied from the water supply tube into the buffer chamber can be more reduced, so that the flush water can be much more precisely supplied to the water supply section along the direction of the water supply passage.

In addition, it is preferable that the buffer chamber has a bottom surface inclined downward toward the water supply portion.

According to the above feature, it can be inhibited that the flush water remains in the buffer chamber.

Advantageous Effects of Invention

According to the feature of the present invention, since the water supply portion is located at a right-sided or left-sided position in a right and left direction with respect to the bowl portion, the size of the flush toilet can be made compact in the forth and back direction.

DESCRIPTION OF EMBODIMENTS

Figure 1:
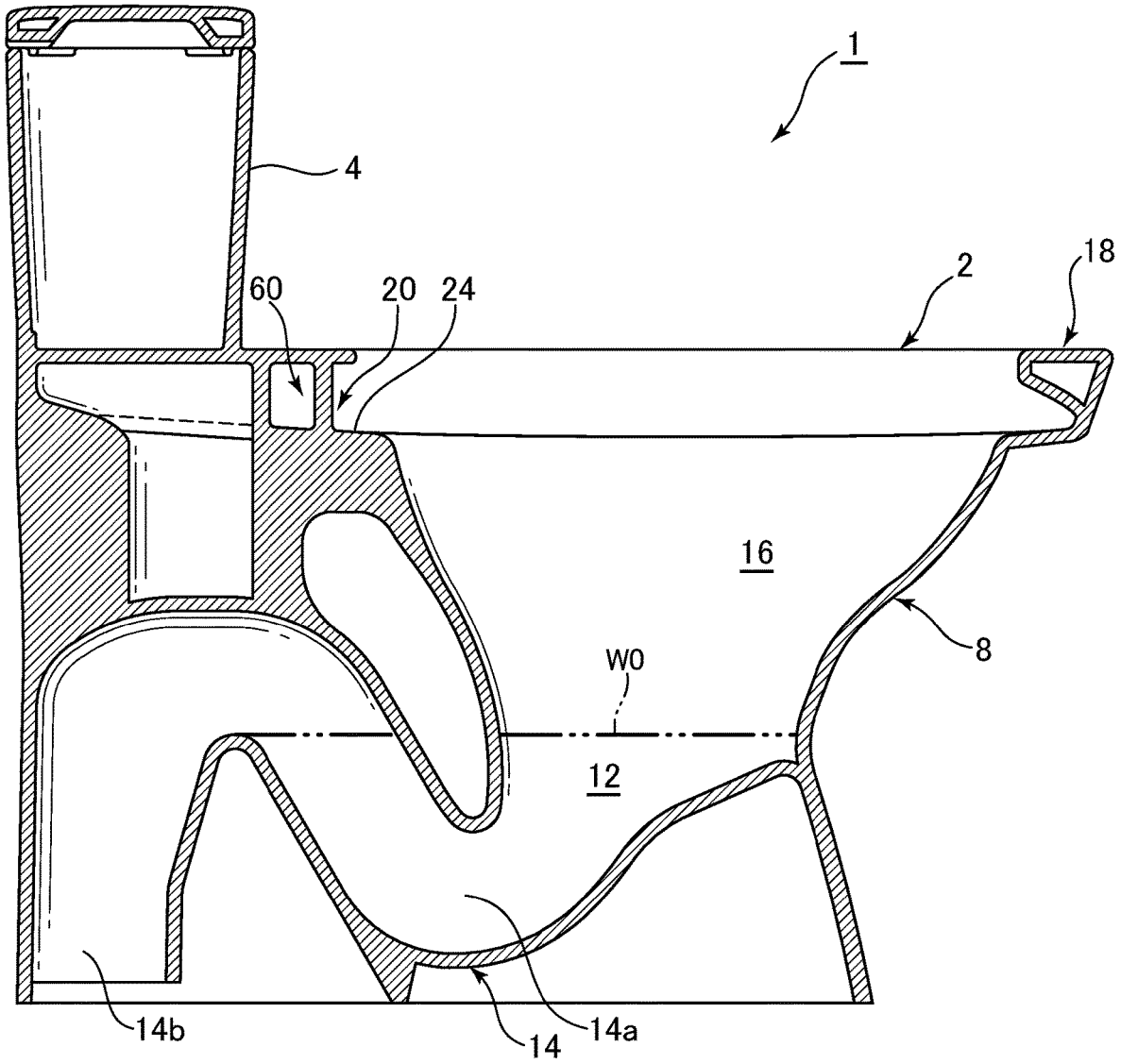
FIG. 1 is a side cross-sectional view showing a flush toilet according to a first embodiment of the present invention.

With reference to the attached drawings, we explain the flush toilet according to the first embodiment of the present invention. FIG. 1 is a side cross-sectional view showing the flush toilet according to the first embodiment of the present invention, FIG. 2 is a plan view showing a main toilet unit of the flush toilet according to the first embodiment of the present invention, and FIG. 3 is a cross section view taken along line III-III of FIG. 2.

It should be noted that any embodiment of the present invention will be described based on the following assumption: a "right side" is defined when viewing a toilet main unit 2 rearwardly from a front side thereof; and a "left side" is also defined when viewing the toilet main unit 2 rearwardly from the front side thereof.

Figure 2:
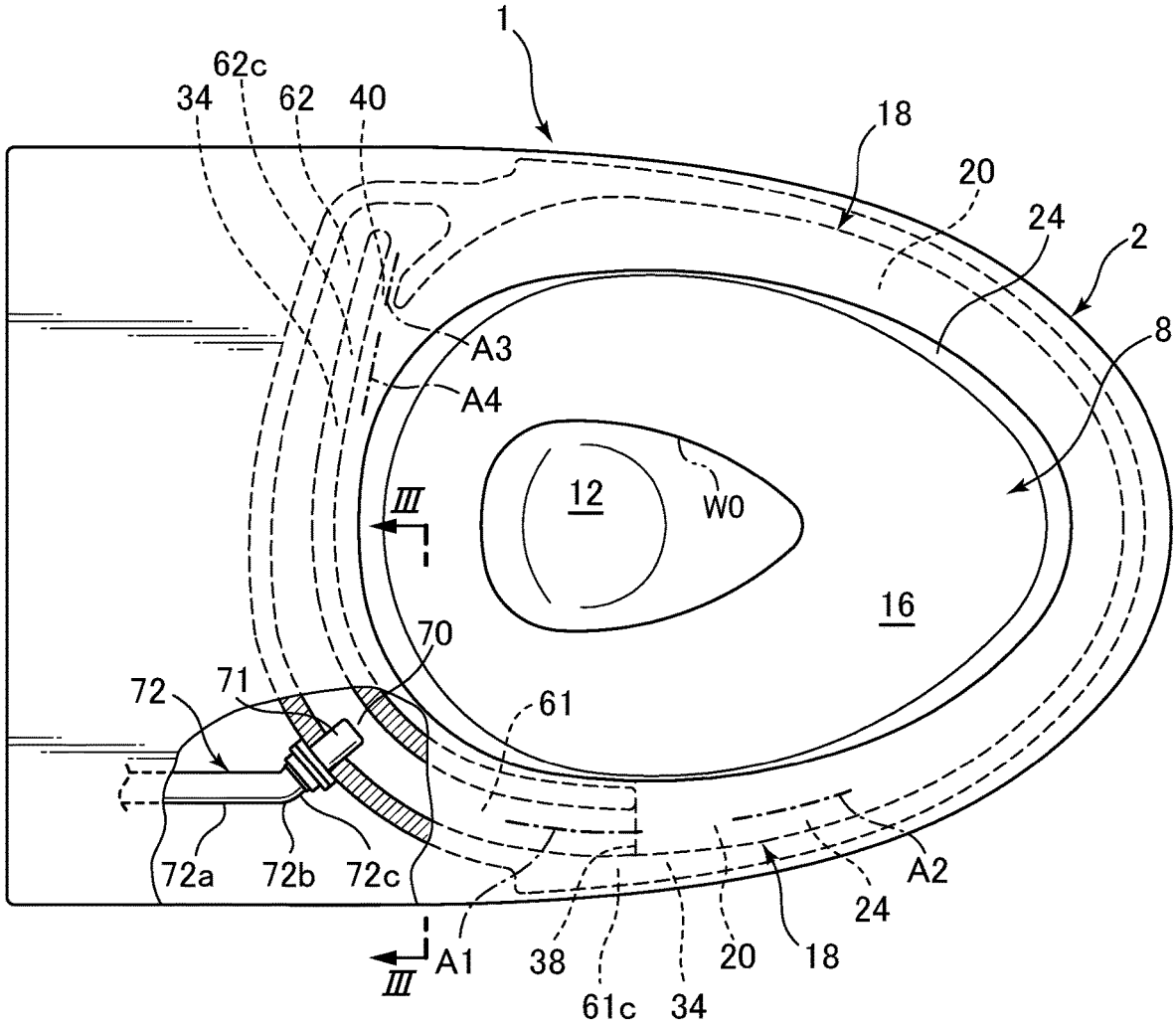
FIG. 2 is a plan view showing a main toilet unit of the flush toilet according to the first embodiment of the present invention.
Figure 3:
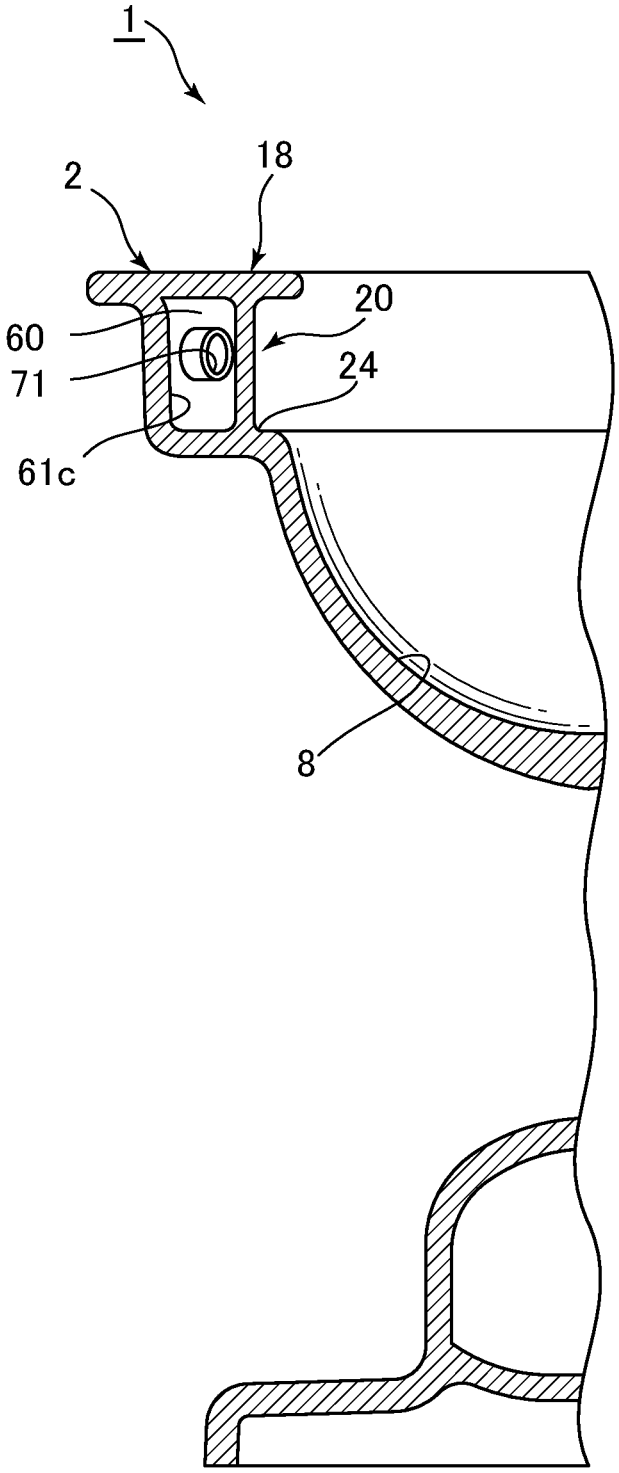
FIG. 3 is a cross section view taken along line III-III of FIG. 2.

As shown in FIGS. 1 to 3, the flush toilet 1 according to the first embodiment of the present invention has a toilet main unit 2 made of porcelain or the like. A water storage tank 4 as a flush water tank is provided on a rear portion of the toilet main unit 2. The water storage tank 4 is connected to a water supply source (not shown) such as a public water system.

When an operation lever or button (not shown) provided on the water storage tank 4 is operated, the flush water is discharged to perform a flush. More specifically, when the operation lever or button is operated, a discharge valve (not shown) of the water storage tank 4 is opened so that a predetermined amount of the flush water (for example, 6 liters) is supplied from the water storage tank 4 to a supply port (not shown) provided on the rear side of the main toilet unit 2.

The flush toilet 1 according to the first embodiment can be used as a water-saving type of flush toilet using 3 liters to 6 liters of the flush water from the water storage tank 4 to perform a flush, more preferably as a water-saving type of flush toilet using 4.8 liters to 6 liters of the flush water from the water storage tank 4 to perform a flush.

Instead of the water storage tank 4, another water supply device may be used, such as a flush valve that can supply a predetermined amount of the flush water.

A bowl portion 8 is formed on an upper side of a front portion of the main toilet unit 2. A water pooling region 12 is formed at a lower part of the bowl portion 8, and a predetermined amount of water is pooled in the water pooling region 12. An initial level of the pooled water is indicated by the sign W0. A lower end of the water pooling region 12 is connected to an inlet 14*a* of a discharge trap pipe 14. The discharge trap pipe 14 extends rearward from the inlet 14*a*. A rear end 14*b* of the discharge trap pipe 14 is connected to a discharge pipe (not shown) provided under a floor surface.

Inside the main toilet unit 2, there is provided a water conduit 60 which is configured to guide the flush water supplied from the supply port provided on the rear side of the main toilet unit 2 toward the bowl portion 8.

The water conduit 60 has a first water-guiding portion 61 extending from a water supply portion 70, where the flush water is supplied to the water conduit 60, to a first spout port 38 located on the left side (on one of right and left sides) of the bowl portion 8, and a second water-guiding portion 62 extending from the water supply portion 70 to a second spout port 40 located on the right side (on the other of the right and left sides) of the bowl portion 8. In addition, as a feature of the present embodiment, the water supply portion 70 is located at a left-sided portion (either at a right-sided portion or at a left-sided position) in a right and left direction with respect to the bowl portion 8.

As shown in FIG. 2, the first water-guiding portion 61 and the second water-guiding portion 62 extend along an inside surface of the water supply portion 70 (and outside an outer peripheral surface of the bowl portion 8) as seen in plan view, respectively. The flush water is supplied to the water supply portion 70 in a direction inclined with respect to a front and back direction and intersected with the inside surface of the water supply portion 70 (as well as intersected with the outer peripheral surface of the bowl portion 8) as seen in plan view. In particular, in the present embodiment, the flush water is supplied to the water supply portion 70 in a direction substantially perpendicular to a tangential direction of the inside surface of the water supply portion 70.

The first water-guiding portion 61 is formed to extend from the water supply portion 70 substantially toward the front portion of the main toilet unit 2. The second water-guiding portion 62 is formed to extend from the water supply portion 70 substantially toward a right side of the main toilet unit 2 and subsequently bend back to the second spout port 40.

In addition, in the present embodiment, as shown in FIG. 2, the first water-guiding portion 61 and the second water-guiding portion 62 are smoothly continuous. The tangential direction of the first water-guiding portion 61 at the water supply portion 70 and the tangential direction of the second water-guiding portion 62 at the water supply portion 70 are substantially identical. The flush water is supplied to the water supply portion 70 in a direction substantially perpendicular to both the tangential directions.

Furthermore, in the present embodiment, the flush water is supplied to the water supply portion 70 by a straight nozzle 71 extending in a direction inclined with respect to the front and back direction and intersected with the inside surface of the water supply portion 70 (as well as intersected with the outer peripheral surface of the bowl portion 8) as seen in plan view. The straight nozzle 71 is connected to a water supply tube 72. The water supply tube 72 has a proximal portion 72*a* extending in the front and back direction, a distal portion 72*c* connected to the straight nozzle 71 and extending in the same direction as the straight nozzle 71, and a bend portion 72*b* bending from the proximal portion 71*a* to the distal portion 71*c*.

The bowl portion 8 also has a waste receiving surface 16 formed in a bowl shape, and a rim portion 18 formed at a top edge part of the bowl portion 8 and configured to spout the flush water toward the waster receiving surface 16.

More specifically, the rim portion 18 is formed at substantially an entire circumference of the top edge part of the bowl portion 8, so that the rim portion 18 can guide the flush water in a well-balanced manner to respective regions in the bowl portion 8. The rim portion 18 is located above the waste receiving surface 16. An inner wall surface of the rim portion 18 is a rim water-passage outer wall surface 34. An upper part of the rim water-passage outer wall surface 34 is formed to project inwardly. In addition, a rim water-passage bottom wall surface 24 of the rim portion 18 is formed to extend horizontally inwardly. Thereby, a rim water passage 20 is formed on the rim water-passage bottom wall surface 24.

The rim water-passage bottom wall surface 24 is formed in a shelf shape in a substantially flat horizontal manner over substantially the entire circumference of the bowl portion 8. Thereby, the flush water that flows on the rim water-passage bottom wall surface 24 of the rim water passage 20 can form a flow around substantially the entire circumference of the upper part of the bowl portion 8.

In addition, in the present embodiment, in a transition region where the first water-guiding portion 61 and the rim water passage 20 are connected, an outer wall surface 61*c* of the first water-guiding portion 61 and the rim water-passage outer wall surface 34 of the rim portion 18 are continuously formed substantially in a flat manner. Thereby, the flush water can smoothly flow from the outer wall surface 61*c* of the first water-guiding portion 61 to the rim water-passage outer wall surface 34 of the rim portion 18.

Similarly, in the present embodiment, in a transition region where the second water-guiding portion 62 and the rim water passage 20 are connected, an outer wall surface 62*c* of the second water-guiding portion 62 and the rim water-passage outer wall surface 34 of the rim portion 18 are continuously formed substantially in a flat manner. Thereby, the flush water can smoothly flow from the outer wall surface 62*c* of the second water-guiding portion 62 to the rim water-passage outer wall surface 34 of the rim portion 18.

In addition, in the present embodiment, in a vicinity of the first spout port 38, a direction in which a central axis A1 of the first water-guiding portion 61 extends and a flow direction A2 of the flush water that goes along the rim water passage 20 in a left-hand region of the bowl portion 8 are substantially identical. Thereby, the flush water spouted from the first spout port 38 flows in substantially the same direction on the rim water passage 20, and thus the flush water can flow around the rim water passage 20 with its power substantially maintained (with the flow amount and the flow speed substantially maintained).

Similarly, in the present embodiment, in a vicinity of the second spout port 40, a direction in which a central axis A3 of the second water-guiding portion 62 extends and a flow direction A4 of the flush water that goes along the rim water passage 20 in a right-hand rear region of the bowl portion 8 are substantially identical. Thereby, the flush water spouted from the second spout port 40 flows in substantially the same direction on the rim water passage 20, and thus the flush water can flow around the rim water passage 20 with its power substantially maintained (with the flow amount and the flow speed substantially maintained).

Next, an operation (action) of the flush toilet 1 according to the first embodiment is explained.

In order to perform a flush, the operation lever or button (not shown) in an operation panel (not shown) is operated so that the discharge valve (not shown) provided in the water storage tank 4 is opened. Then, a predetermined amount of the flush water (for example, 6 liters) is supplied from the water storage tank 4 into the main toilet unit 2 through the supply port (not shown) provided on the rear side of the main toilet unit 2. More specifically, the flush water is supplied into the water supply portion 70 through the water supply tube 72 and the straight nozzle 71.

Subsequently, the flush water supplied from the water supply portion 70 to the water conduit 60 is divided into the first water-guiding portion 61 and the second water-guiding portion 62.

The flush water spouted from the first spout port 38 through the first water-guiding portion 61 flows on the rim water passage 20 along the flow line A2, and swirls down from the rim water-passage bottom wall surface 24 toward the waste receiving surface 16 while washing the bowl portion 8.

Similarly, the flush water spouted from the second spout port 40 through the second water-guiding portion 62 flows on the rim water passage 20 along the flow line A4, and swirls down from the rim water-passage bottom wall surface 24 toward the waste receiving surface 16 while washing the bowl portion 8.

The flush water that has swirled down while washing the bowl portion 8 is discharged from the discharge trap pipe 14 together with waste. Then, a sequence of flush operations for the main toilet unit 2 is completed.

According to the flush toilet 1 of the first embodiment as described above, since the water supply portion 70 is located at the left-sided position (either at a right-sided portion or at a left-sided position) in the right and left direction with respect to the bowl portion 8, the size of the flush toilet 1 can be made compact in the forth and back direction.

In addition, according to the flush toilet 1 of the first embodiment, the first water-guiding portion 61 and the second water-guiding portion 62 are smoothly continuous, the tangential direction of the first water-guiding portion 61 at the water supply portion 70 and the tangential direction of the second water-guiding portion 62 at the water supply portion 70 are substantially identical, and the flush water is supplied to the water supply portion 70 in a direction substantially perpendicular to both the tangential directions. Thus, the flush water can be divided into the first water-guiding portion 61 and the second water-guiding portion 62 in accordance with a desired ratio, and the power (the flow amount and the flow speed) of the respective flush waters can be also maintained sufficiently.

In addition, according to the flush toilet 1 of the first embodiment, the flush water is supplied to the water supply portion 70 by the straight nozzle 71 extending in the direction inclined with respect to the front and back direction and intersected with the inside surface of the water supply portion 70 (as well as intersected with the outer peripheral surface of the bowl portion 8) as seen in plan view, and the straight nozzle 71 is connected to the water supply tube 72. The water supply tube 72 has the proximal portion 72*a* extending in the front and back direction, the distal portion 72*c* connected to the straight nozzle 71 and extending in the same direction as the straight nozzle 71, and the bend portion 72*b* bending from the proximal portion 71*a* to the distal portion 71*c*. According to these features, an operation for setting the straight nozzle 71 is easy. In addition, a space in which the straight nozzle 71 is to be set can be also made compact.

In addition, in the flush toilet 1 of the first embodiment, by adjusting an angle at which the flush water is supplied to the water supply portion 70, a ratio (distribution ratio) between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) can be adjusted to a desired value. It is relatively easy to perform this adjustment by changing a setting angle of the straight nozzle 71 with respect to the water supply portion 70.

Figure 4:
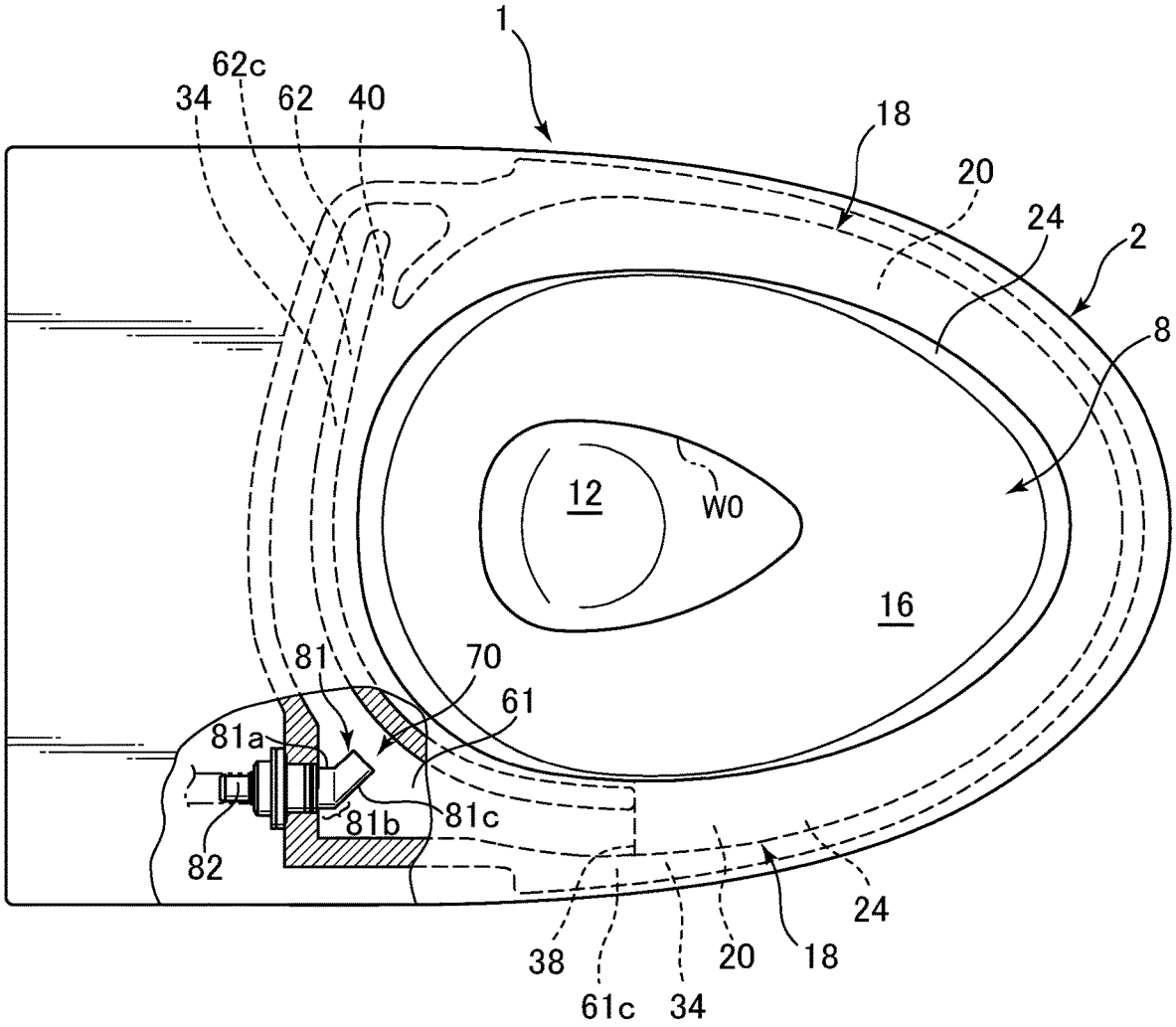
FIG. 4 is a plan view showing a main toilet unit of a flush toilet according to a second embodiment of the present invention.

Next, FIG. 4 is a plan view showing a main toilet unit of a flush toilet according to a second embodiment of the present invention. In the second embodiment, a bend nozzle 81 and a straight water supply tube 82 are used, instead of the straight nozzle 71 and the bend water supply tube 72.

More specifically, in the second embodiment, the flush water is supplied to the water supply portion 70 by the bend nozzle 81. The bend nozzle 81 has a proximal portion 81*a* extending in the front and back direction, a distal portion 81*c* extending in a direction inclined with respect to the front and back direction and intersected with the inside surface of the water supply portion 70 (as well as intersected with the outer peripheral surface of the bowl portion 8) as seen in plan view, and a bend portion 81*b* bending from the proximal portion 81*a* to the distal portion 81*c*. The bend nozzle 81 is connected to the straight water supply tube 82 extending in the front and back direction.

In order to facilitate an operation for setting the bend nozzle 81, the water conduit 60 is expanded in a vicinity of the water supply portion 70.

The other structure of the second embodiment is substantially the same as the first embodiment explained with reference to FIGS. 1-3. In FIG. 4, the same portions as those of the first embodiment are shown by the same reference numerals, and detailed explanation thereof is omitted.

According to the second embodiment, an operation for setting the bend nozzle 81 is easy. In addition, a space in which the bend nozzle 81 is to be set can be also made compact.

Figure 5:
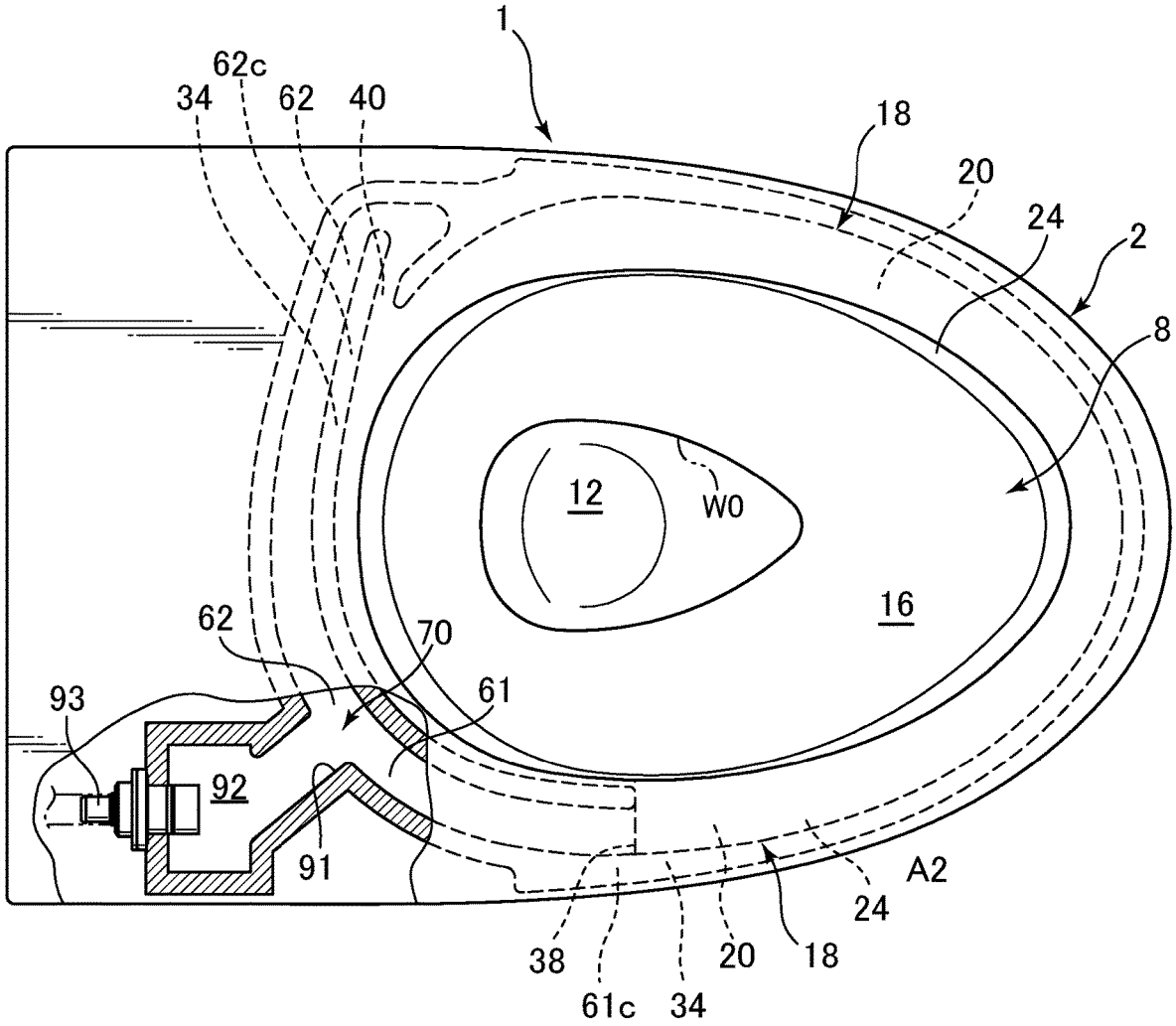
FIG. 5 is a plan view showing a main toilet unit of a flush toilet according to a third embodiment of the present invention.

Next, FIG. 5 is a plan view showing a main toilet unit of a flush toilet according to a third embodiment of the present invention. In the third embodiment, a buffer chamber which allows the flush water to temporarily stay is used to guide the flow direction of the flush water toward the water supply portion 70, instead of a member in which a bend flow path has been formed (such as the bend water supply tube 72 or the bend nozzle 81).

Specifically, in the third embodiment, the flush water is supplied to the water supply portion 70 by a water supply passage 91 extending in a direction inclined with respect to the front and back direction and intersected with the inside surface of the water supply portion 70 (as well as intersected with the outer peripheral surface of the bowl portion 8) as seen in plan view; and the water supply passage 91 is connected to a straight water supply tube 93 via a buffer chamber 92 which allows the flush water to temporarily stay.

In the example shown in FIG. 5, an entrance of the water supply passage 91 is located in the flow direction of the flush water from the straight water supply tube 93 into the buffer chamber 92.

The other structure of the third embodiment is substantially the same as the first embodiment explained with reference to FIGS. 1-3. In FIG. 5, the same portions as those of the first embodiment are shown by the same reference numerals, and detailed explanation thereof is omitted.

According to the above embodiment, since the flush water is allowed to temporarily stay in the buffer chamber 92, effects caused by a direction in which the flush water is supplied from the water supply tube 93 into the buffer chamber 92 can be reduced, so that the flush water can be more precisely supplied to the water supply section 70 along the direction of the water supply passage 91.

Figure 6:
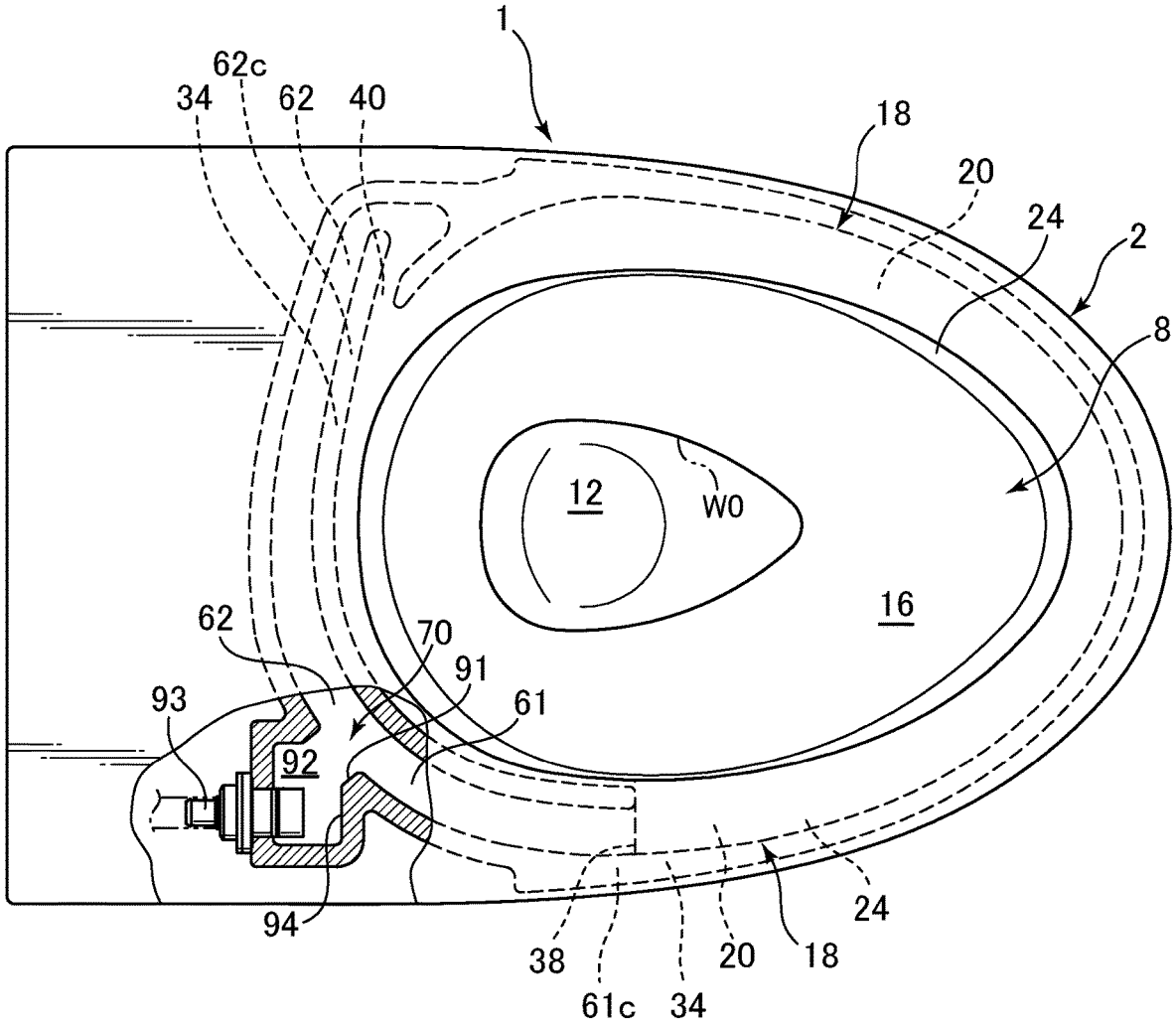
FIG. 6 is a plan view showing a main toilet unit of a flush toilet according to a fourth embodiment of the present invention.

Herein, it is preferable to provide a wall that reduces the flow speed of the flush water at a position against a direction in which the flush water is supplied from the water supply tube 93 into the buffer chamber 92. Such an embodiment is shown in FIG. 6 as a fourth embodiment. FIG. 6 is a plan view showing a main toilet unit of a flush toilet according to a fourth embodiment of the present invention.

According to the fourth embodiment, since there is provided the wall 94 that reduces the flow speed of the flush water at a position against a direction in which the flush water is supplied from the water supply tube 93 into the buffer chamber 92, the effects caused by the direction in which the flush water is supplied from the water supply tube 93 into the buffer chamber 92 can be more reduced, so that the flush water can be much more precisely supplied to the water supply section 70 along the direction of the water supply passage 91. Herein, it is preferable that the inner wall surface of the wall 94 of the buffer chamber 92 is substantially perpendicular to the direction in which the flush water is supplied from the water supply tube 93 into the buffer chamber 92

In addition, in a flush toilet according to the third embodiment or the fourth embodiment, it is preferable that the buffer chamber 92 has a bottom surface inclined downward toward the water supply portion 70. According to this feature, it can be inhibited that the flush water remains in the buffer chamber 92.

What is claimed is:

1. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion, the water supply portion is located at a right-sided or left-sided position in a right and left direction with respect to the bowl portion, the flush water is supplied to the water supply portion in a direction toward an opposite side with respect to the right-sided or left-sided position of the water supply portion inclined with respect to a front and back direction and intersected with an inside surface of the water supply portion, as seen in plan view.

2. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion, the water supply portion is located at a right-sided or left-sided position in a right and left direction with respect to the bowl portion, the flush water is supplied to the water supply portion in a direction inclined with respect to a front and back direction and intersected with an inside surface of the water supply portion, as seen in plan view, and the flush water is supplied to the water supply portion in a direction substantially perpendicular to a tangential direction of the inside surface of the water supply portion.

3. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion, the water supply portion is located at a right-sided or left-sided position in a right and left direction with respect to the bowl portion, the flush water is supplied to the water supply portion in a direction inclined with respect to a front and back direction and intersected with an inside surface of the water supply portion, as seen in plan view, the flush water is supplied to the water supply portion by a straight nozzle extending in a direction inclined with respect to the front and back direction and intersected with the inside surface of the water supply portion, as seen in plan view, the straight nozzle is connected to a water supply tube, and the water supply tube has a proximal portion extending in the front and back direction, a distal portion connected to the straight nozzle and extending in the same direction as the straight nozzle, and a bend portion bending from the proximal portion to the distal portion.

4. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion, the water supply portion is located at a right-sided or left-sided position in a right and left direction with respect to the bowl portion, the flush water is supplied to the water supply portion in a direction inclined with respect to a front and back direction and intersected with an inside surface of the water supply portion, as seen in plan view, the flush water is supplied to the water supply portion by a bend nozzle, the bend nozzle has a proximal portion extending in the front and back direction, a distal portion extending in a direction inclined with respect to the front and back direction and intersected with the inside surface of the water supply portion as seen in plan view, and a bend portion bending from the proximal portion to the distal portion, and the bend nozzle is connected to a water supply tube extending in the front and back direction.

5. The flush toilet according to claim 1, wherein the flush water is supplied to the water supply portion by a water supply passage extending in a direction inclined with respect to the front and back direction and intersected with the inside surface of the water supply portion, as seen in plan view, and the water supply passage is connected to a water supply tube via a buffer chamber which allows the flush water to temporarily stay.

6. The flush toilet according to claim 5, wherein the buffer chamber has a wall formed at a position against a direction in which the flush water is supplied from the water supply tube into the buffer chamber.

7. The flush toilet according to claim 5, wherein the buffer chamber has a bottom surface inclined downward toward the water supply portion.

* * * * *